US010557387B2

(12) United States Patent
Friedfeldt et al.

(10) Patent No.: US 10,557,387 B2
(45) Date of Patent: Feb. 11, 2020

(54) INTERNAL COMBUSTION ENGINE COMPRISING A VALVE TRAIN WITH VALVE SPRINGS AND METHOD FOR MOUNTING SUCH A VALVE SPRING

(71) Applicant: Ford Global Technologies, LLC, Dearborn, MI (US)

(72) Inventors: Rainer Friedfeldt, Huerth (DE); Peter Borkenhagen, Cologne (DE); Ulrich Heiter, Dormagen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 21 days.

(21) Appl. No.: 15/934,506

(22) Filed: Mar. 23, 2018

(65) Prior Publication Data

US 2018/0291774 A1 Oct. 11, 2018

(30) Foreign Application Priority Data

Apr. 11, 2017 (DE) ..... 10 2017 206 151

(51) Int. Cl.

| | |
|---|---|
| ***F16F 13/00*** | (2006.01) |
| ***F01L 1/46*** | (2006.01) |
| ***F01L 3/08*** | (2006.01) |
| ***F01L 3/10*** | (2006.01) |
| *F01L 1/047* | (2006.01) |

(52) U.S. Cl.

CPC ..... *F01L 1/462* (2013.01); *F01L 3/08* (2013.01); *F01L 3/10* (2013.01); *F01L 1/047* (2013.01)

(58) Field of Classification Search

CPC ..... F01L 1/462; F01L 3/10; F01L 3/08

USPC ..... 123/90.65, 90.66, 90.67

See application file for complete search history.

(56) References Cited

U.S. PATENT DOCUMENTS

| | | | | |
|---|---|---|---|---|
| 992,089 | A | 5/1911 | Watt | |
| 1,789,209 | A | 1/1931 | Asbury | |
| 3,556,062 | A | 1/1971 | Shermeister | |
| 4,380,216 | A | 4/1983 | Kandler | |
| 4,507,917 | A | 4/1985 | Kandler | |
| 4,513,701 | A | 4/1985 | Sternberg et al. | |
| 5,199,392 | A | 4/1993 | Kreuter et al. | |
| 5,245,957 | A | 9/1993 | Bornstein et al. | |
| 5,246,215 | A | 9/1993 | Takamura et al. | |
| 5,343,835 | A | 9/1994 | Rhodes | |
| 5,381,765 | A | 1/1995 | Rhodes | |
| 6,532,925 | B1 | 3/2003 | Moya | |
| 7,322,321 | B2 | 1/2008 | Robinson | |
| 8,056,520 | B2 * | 11/2011 | Elendt ..... | F01L 1/462 123/90.24 |
| 9,328,845 | B1 | 5/2016 | Niermann, Jr. | |

FOREIGN PATENT DOCUMENTS

| | | | |
|---|---|---|---|
| DE | 202006019979 | U1 | 8/2007 |
| EP | 1741881 | A2 | 1/2007 |

* cited by examiner

*Primary Examiner* — Ching Chang
(74) *Attorney, Agent, or Firm* — Geoffrey Brumbaugh; McCoy Russell LLP

(57) ABSTRACT

Methods and systems are provided for cylinder valves of an internal combustion engine. In one example, a valve assembly may include a poppet valve and a valve spring. The valve spring includes a plurality of legs adapted to engage with an annular groove of the valve spring in order to couple the valve spring to the poppet valve.

20 Claims, 4 Drawing Sheets

INTERNAL COMBUSTION ENGINE COMPRISING A VALVE TRAIN WITH VALVE SPRINGS AND METHOD FOR MOUNTING SUCH A VALVE SPRING

CROSS REFERENCE TO RELATED APPLICATION

This application claims priority to German Patent Application No. 102017206151.0, filed Apr. 11, 2017. The entire contents of the above-referenced application are hereby incorporated by reference in their entirety for all purposes.

FIELD

The present description relates generally to methods and systems for cylinder valves of an internal combustion engine.

BACKGROUND/SUMMARY

In four-stroke internal combustion engines, in order to control the charge change, poppet valves may be used. The poppet valves are movable along their longitudinal axis between a valve closing position and a valve opening position. During operation of an internal combustion engine, the poppet valves execute an oscillating stroke motion in order to open or close inlet and outlet openings of cylinders of the engine.

An actuating device of a poppet valve is often referred to as a valve train. The valve train may oscillate the poppet valve to open and close the corresponding inlet or outlet opening of the cylinder to which the poppet valve is coupled. A valve spring may be provided in order to preload the poppet valve in a direction of the valve closing position, and the valve-actuating device or valve train is provided in order to open the valve, opposite to a preload force of the valve spring. Often, the valve train comprises a camshaft with a cam, with at least one cam follower element disposed between the cam and the poppet valve.

Attempts to address coupling the poppet valve to the valve spring and valve train include providing fasteners to join the components to each other. One example approach is shown in European Patent 1 741 881 B1. Therein, a valve spring retainer is formed integrally with intermediate elements of a valve train.

However, the inventors herein have recognized potential issues with such systems. As one example, fasteners or valve spring retainers such as those disclosed by the '881 patent may increase a weight of the valve spring, poppet valve, and/or valve train, which may result in a decreased responsiveness of the poppet valve. Further, such fasteners or valve spring retainers may increase a cost and/or assembly time of the engine.

In one example, the issues described above may be addressed by an internal combustion engine, comprising: at least one cylinder head comprising at least one cylinder, where each cylinder has at least one outlet opening for discharging exhaust gases via an exhaust gas discharge system and at least one inlet opening for supplying fresh air via an intake system, where, for each outlet and inlet opening, a poppet valve of a valve train and a valve-actuating device included with a camshaft is provided for actuating the poppet valve, and where each poppet valve has a valve stem on a cylinder-side end, facing the at least one cylinder where a valve retainer corresponding to the at least one outlet opening or at least one inlet opening is arranged, and where each poppet valve has an end on a valve train side which faces the valve-actuating device, with each poppet valve mounted so as to be translationally movable in a corresponding sleeve-like valve stem guide so that on actuation and with the camshaft rotating, each poppet valve executes an oscillating stroke movement in a direction of its longitudinal axis between a valve closing position and a valve opening position in order to open and block the corresponding outlet or inlet opening, wherein each poppet valve includes a coil spring as a valve spring which pretensions the poppet valve in a direction of the valve closing position; and wherein each coil spring comprises several windings and rests on a cylinder side on the at least one cylinder head and on the valve train side on the valve stem, wherein a groove is provided running around the valve stem, wherein the last winding of the coil spring on the valve train side engages the groove, so that a form-fit connection is created between the valve stem and the last winding. In this way, a number of fasteners or other separate components used to operate the poppet valve may be reduced, which may reduce a weight and/or cost of the poppet valve and/or increase engine performance.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-7 are shown to scale, though other relative dimensions may be used, if desired.

DETAILED DESCRIPTION

Figure 4:
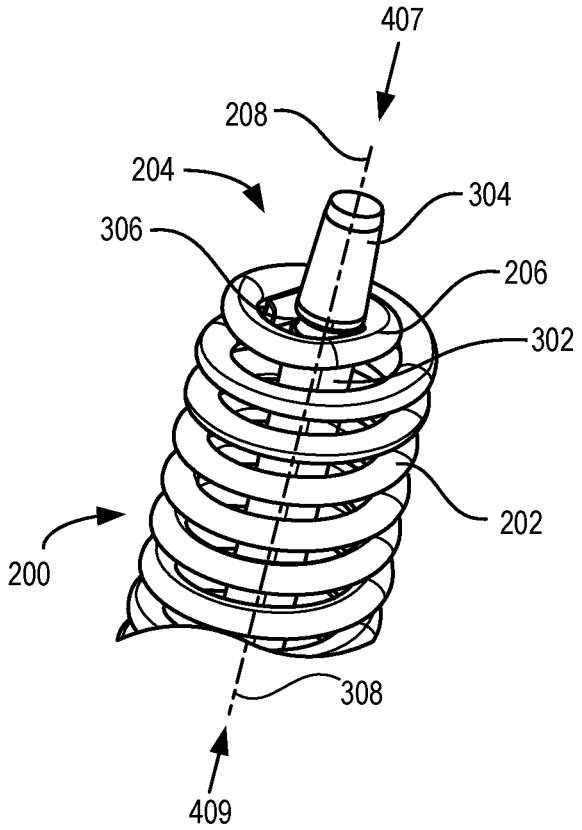
FIG. 4 shows a perspective view of the coil spring of FIG. 2 coupled to the valve stem of FIG. 3 in a mounted state.
Figure 5:
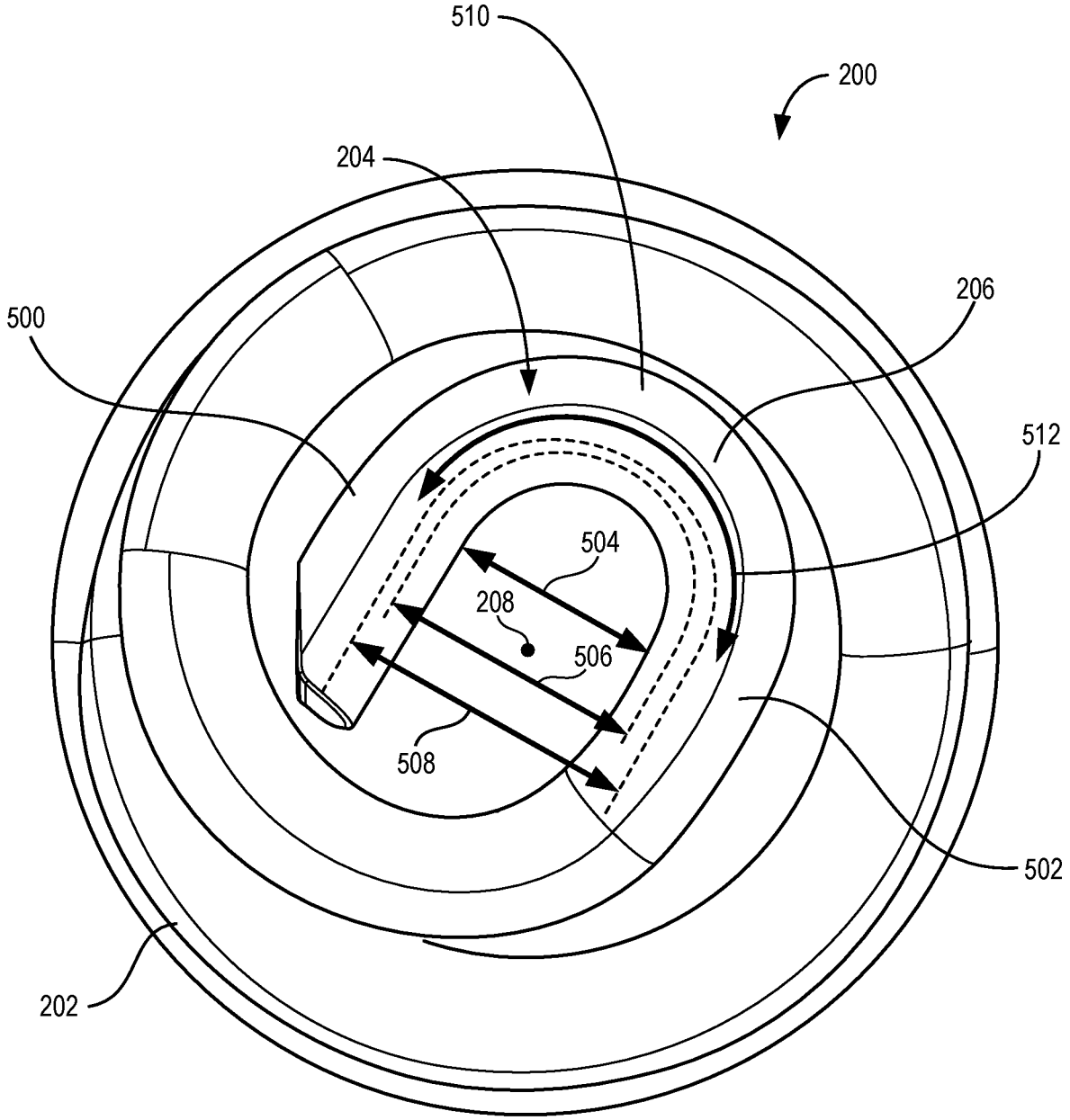
FIG. 5 shows a view of an end of the coil spring of FIGS. 2 and 4 at a valve train side of the coil spring and along a longitudinal axis of the coil spring.
Figure 6:
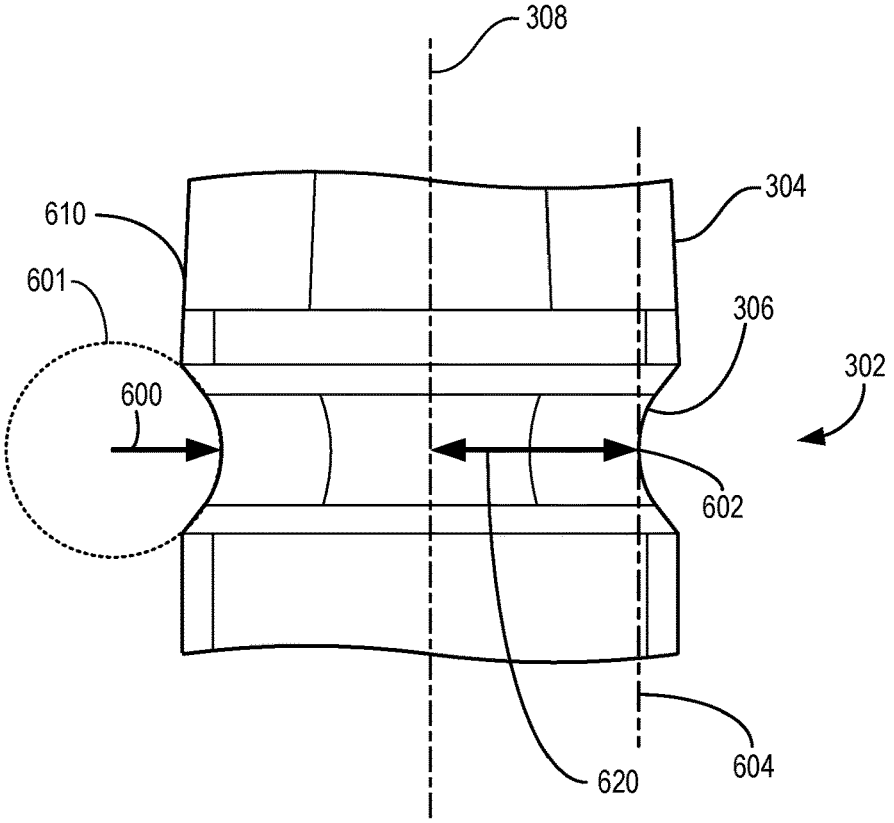
FIG. 6 shows a partial, side view of the valve stem of FIGS. 3-4.
Figure 7:
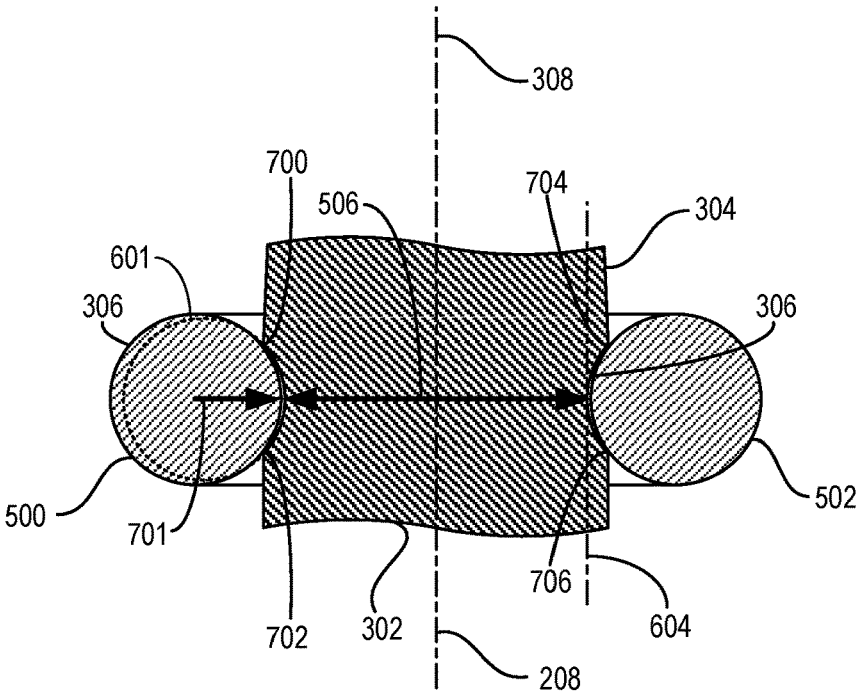
FIG. 7 shows a partial, cross-sectional view of the coil spring of FIGS. 2 and 4-5 coupled to the valve stem of FIGS. 3-4 and 6 in the mounted state.

The following description relates to systems and methods for cylinder valves of an internal combustion engine. An engine, such as the engine shown by FIG. 1, includes a plurality of cylinders or combustion chambers configured to receive intake air and exhaust combustion gases via a plurality of poppet valves. Each poppet valve is coupled to a corresponding valve spring having a plurality of windings, such as the valve spring shown by FIG. 2. The valve spring includes an end having a last winding shaped to couple with a stem of the poppet valve, such as the valve stem shown by FIG. 3. The end of the valve spring coupled with the valve stem in a mounted state, as shown by FIG. 4. The end of the valve spring includes a last winding having opposing legs, as shown by FIG. 5, and the valve stem includes an annular groove, as shown by FIG. 6. In the mounted state, the opposing legs of the valve spring couple around the groove of the valve stem in order to maintain a position of the valve spring with respect to the valve stem, as shown by FIG. 7. In this way, the valve spring couples to the poppet valve without additional fasteners.

Before turning to the figures, as described herein, an internal combustion engine with at least one cylinder head comprises at least one cylinder, in which: each cylinder has at least one outlet opening for discharging exhaust gases via an exhaust gas discharge system, and at least one inlet opening for supplying fresh air via an intake system, for each opening, a valve train is provided comprising a poppet valve and a valve-actuating device with a camshaft for actuating the poppet valve, and each poppet valve has a valve stem, on the cylinder-side end of which facing the cylinder a valve retainer corresponding to the opening is arranged, and the other end of which on the valve train side faces the valve-actuating device, and which is mounted so as to be translationally movable in a sleeve-like valve stem guide, so that on actuation and with the camshaft rotating, the valve executes an oscillating stroke movement in the direction of its longitudinal axis between a valve closing position and a valve opening position in order to open and block the opening, wherein each poppet valve is equipped with a coil spring as a valve spring which pretensions the valve in the direction of the valve closing position. A method for mounting the valve spring of the valve train of the internal combustion engine is also provided.

Figure 1:
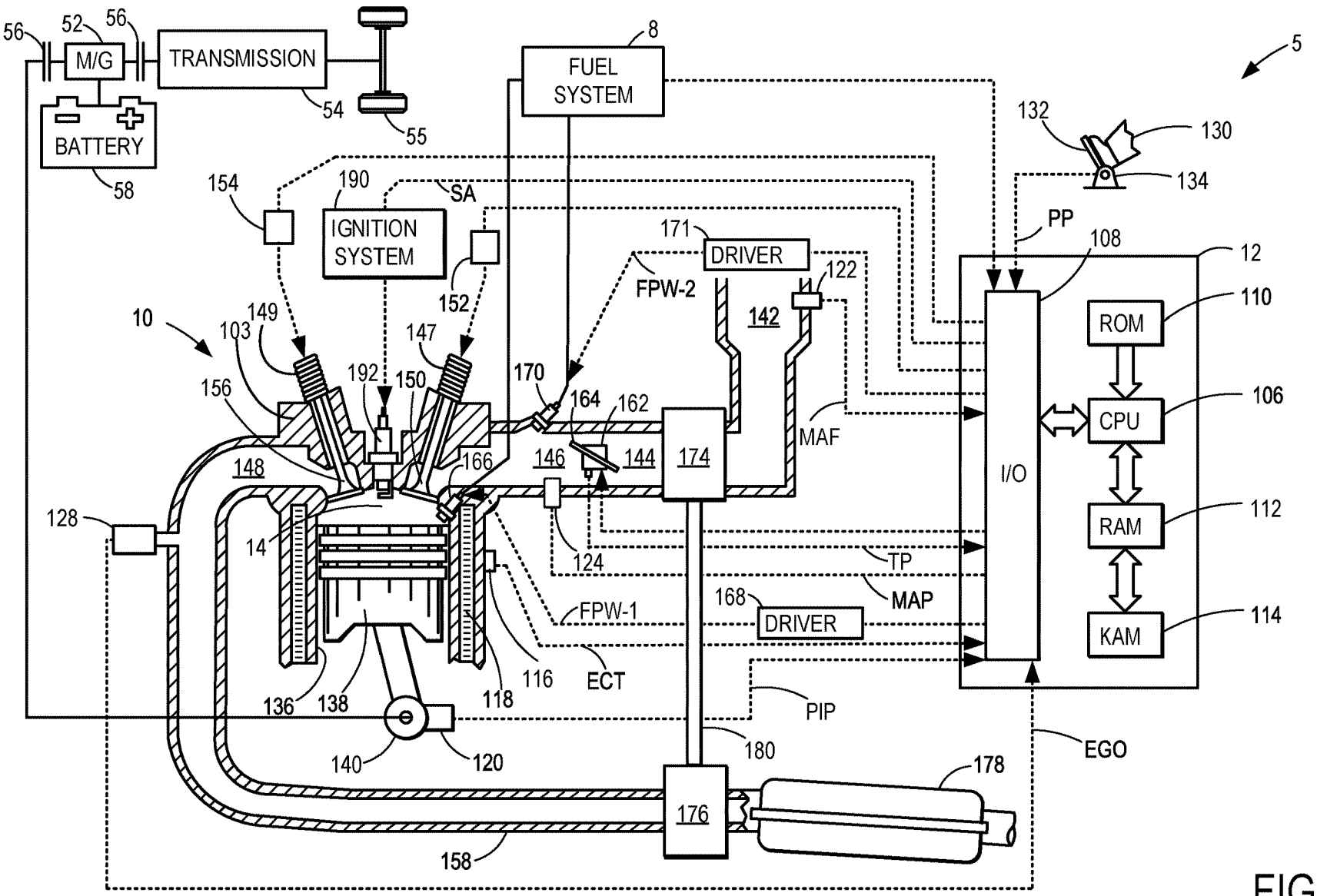
FIG. 1 schematically shows a vehicle including an internal combustion engine having a plurality of cylinder valves, with each cylinder valve coupled to a corresponding coil spring and valve train.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Internal combustion engine 10, as described herein, may be used for example as a drive for motor vehicle 5. The expression "internal combustion engine" may encompass diesel engines, Otto-cycle engines, and also hybrid internal combustion engines (e.g., internal combustion engines which utilize a hybrid combustion process). Specifically, engine 10 may be a diesel engine, Otto-cycle engine, or hybrid electric engine. An internal combustion engine such as engine 10 may have an electric machine which can be connected to the engine to drive the internal combustion engine, and the electric machine may receive power from the internal combustion engine and/or additionally output power to drive the vehicle including the engine. Thus, engine 10 is one example of an engine that may include the poppet valves, valve springs, and valve trains described herein.

Engine 10 includes a cylinder block and at least one cylinder head (e.g., cylinder head 103) which are connected together to form the cylinders (which may be referred to herein as combustion chambers), such as cylinder 14. Bores for the cylinders are provided in the cylinder head and in the cylinder block. The cylinder block provides an upper crankcase half and serves for mounting the crankshaft and for receiving the piston (e.g., piston 138) or cylinder tube of each cylinder. The cylinder head may accommodate valve trains for charge change (e.g., flowing intake air into the cylinders and flowing combustion gases out of the cylinders). During the charge change, combustion gases are discharged via the exhaust gas discharge system through the at least one outlet opening (e.g., an exhaust port sealed by exhaust valve 156), and fresh air is supplied via the intake system through the at least one inlet opening of the cylinder (e.g., an intake port sealed by the intake valve 150). At least parts of the intake system and exhaust gas discharge system are integrated in the cylinder head.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 includes one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

In order to control the charge change, poppet valves (e.g., intake valve 150 and exhaust valve 156) are used which are movable along their longitudinal axis between a valve closing position and a valve opening position. During operation of the internal combustion engine, the poppet valves execute an oscillating stroke motion in order to open or close the inlet and outlet openings (e.g., intake valve 150 opens or closes the respective intake port of cylinder 14, and exhaust valve 156 opens or closes the respective exhaust port of cylinder 14).

The actuating mechanism of each poppet valve may be referred to herein as a valve train. The valve trains may open and/or close the inlet and outlet openings of the cylinders of engine 10. A rapid opening with higher flow cross-section may be desired in order to reduce choke losses of inflowing and outflowing gases, and to provide increased filling of the cylinders with intake air and/or increased expulsion of combustion gases.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

To actuate a poppet valve, firstly a valve spring is provided in order to preload the valve in the direction of the valve closing position, and secondly a valve-actuating device (e.g., actuator 152 or actuator 154) is provided in order to open the valve counter to the preload force of said valve spring.

In the example shown by FIG. 1, the engine 10 includes valve springs 147 and 149, with valve spring 147 coupled to intake poppet valve 150 and valve spring 149 coupled to exhaust poppet valve 156. Examples of valve springs similar to the valve springs 147 and 149 are described below with reference to FIGS. 2 and 4-7.

The valve-actuating device of a valve (e.g., poppet valve) may comprise a camshaft with a cam, at least one cam follower element which is arranged in the force flow between the camshaft and the associated valve (e.g., between the cam of the camshaft and the associated valve).

Intermediate elements of the valve-actuating device (e.g., the valve train components lying or arranged in the force flow between the cam and the valve) may be described herein as cam follower elements.

For the inlet valves and the outlet valves (e.g., intake poppet valves and exhaust poppet valves), there is provided in each case one camshaft which is set in rotation by the crankshaft for example via a traction mechanism drive, such that the camshaft, and the cams together therewith, may rotate at half the rotational speed of the crankshaft. Here, a distinction is basically made between an underlying camshaft and an overhead camshaft, wherein the reference point for these designations is the parting plane between the cylinder block and the cylinder head. In one example, each of the intake poppet valves may be driven by a first camshaft, and each of the exhaust poppet valves may be driven by a second camshaft.

The valve train or a valve stem guide of each valve train is supplied with oil for lubrication in the contact surface between the valve stem guide and the valve stem (for example, from the sides of the valve-actuating device).

In some examples, the valve springs described herein may be coil springs. The valve springs may be formed from a round wire in some examples, whereby several windings are formed by coiling. The valve spring is configured to preload the valve in the direction of the valve closing position to keep the valve closed. Further, the valve spring is configured to transfer or return the opened valve to the valve closing position during the charge change.

On the cylinder side (e.g., a side of the valve spring facing the cylinder during conditions in which the valve spring and corresponding poppet valve are coupled to the cylinder head), the valve spring rests on the cylinder head. On the valve train side of the valve spring (e.g., a side of the valve spring facing the valve train, opposite to the cylinder side), the valve spring couples to the poppet valve via a groove within a valve stem of the poppet valve, as described in the examples below.

With regard to conventional systems of valve springs, poppet valves, and valve trains, a valve spring retainer often serves as a support or counter-bearing and is provided on and attached to the valve stem. The valve spring retainer receives a last winding of the valve spring (e.g., coil spring) on the valve train side, so the spring end on the valve train side is usually shaped and/or sized for this purpose.

The valve spring retainer is often a separate component which has a bore in the center and is pushed onto the valve stem and attached during installation of the valve train. The valve stem is inserted into the bore of the mounted valve spring retainer. To maintain the valve spring retainer on the stem, wedges or conical rings, in some cases formed from multiple pieces, may be used as intermediate elements. During installation, a force-fit connection between the valve stem and the valve spring retainer may be formed using at least one intermediate element. To receive the at least one intermediate element, a recess or ring groove may be provided in the valve stem.

However, with regard to the present disclosure, the number of components may be reduced and/or installation of the poppet valve and/or valve spring may be simplified. Specifically, the valve train described herein with regard to the present disclosure has no conventional valve spring retainer as a support on the valve train side. Along with the valve spring retainer, the intermediate elements are also omitted with respect to the conventional systems described above.

The omission of the valve spring retainer on the valve train side and intermediate elements or fixing with respect to the conventional systems described above also reduces a mass and weight of moved parts in the valve train. In particular, a less stiff spring may be used to reduce lifting between the cam and the associated cam follower element. Further, friction produced by components of the valve train may be reduced, and installation may be simplified. For example, on the valve train side, the valve spring rests on (e.g., is coupled to) the valve stem. To couple the valve spring to the valve stem, a groove is provided running around the valve stem, in which the last winding of the coil spring on the valve train side engages. Using the engagement of the groove and the last winding, a form-fit connection is created between the valve stem and the coil spring.

During installation of the valve train, the valve spring is pressed onto the valve stem and pushed along the longitudinal axis of the valve in the direction of the valve spring retainer until the last winding of the coil spring engages or catches, at least in portions, in the groove provided in the valve stem. For this, on installation, the last winding is spread starting from a first winding diameter or spacing of the unloaded spring, initially under the effect of force, to a larger, second spacing in order to ensure that the form fit between the groove and the engaging spring winding is maintained. For example, after installation of the valve spring on the valve stem, the valve spring may be only be separated from the valve stem under renewed force action. On engagement or catching of the last winding in the groove, the spacing reduces to a smaller, third spacing, with the third spacing being less than the second spacing. Further, the third spacing is greater than the first spacing. In addition to the form fit due to engagement, the valve spring and valve stem are force fit together due to the spring spreading force.

Each valve train of engine 10 may be configured as described above (e.g., with each valve spring having an end coupled to a corresponding groove of a corresponding valve stem). Further examples are described below with reference to FIGS. 2-7.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIGS. 2 and 3, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as Eli) (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature. The controller 12 receives signals from the various sensors of FIG. 1 and employs the various actuators of FIG. 1 to adjust engine operation based on the received signals and instructions stored on a memory of the controller.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

In some examples, as described above, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

Turning now to FIGS. 2-7, FIG. 2 shows a perspective view of a valve spring 200 (which may be referred to herein as a biasing member and/or coil spring) of an internal combustion engine, such as the engine 10 shown by FIG. 1 and described above. In some examples, the valve spring 200 may be similar to the valve spring 147 and/or valve spring 149 shown schematically by FIG. 1 and described above.

The coil spring 200 may be made from a round wire and comprises several windings 202, wherein a last winding 206 (which may be referred to herein as an end coil) positioned at the end 204 of the spring 200 on valve train side 407 (e.g., the last winding 206 of the coil spring 200 on the valve train side 407, shown by FIG. 4) has a reduced diameter (e.g., smaller diameter) relative to each other winding 202. The coil spring 200 includes a central axis 208, which may be referred to herein as a longitudinal axis. The windings 202 encircle the central axis 208 and are centered on the central axis 208.

Figure 2:
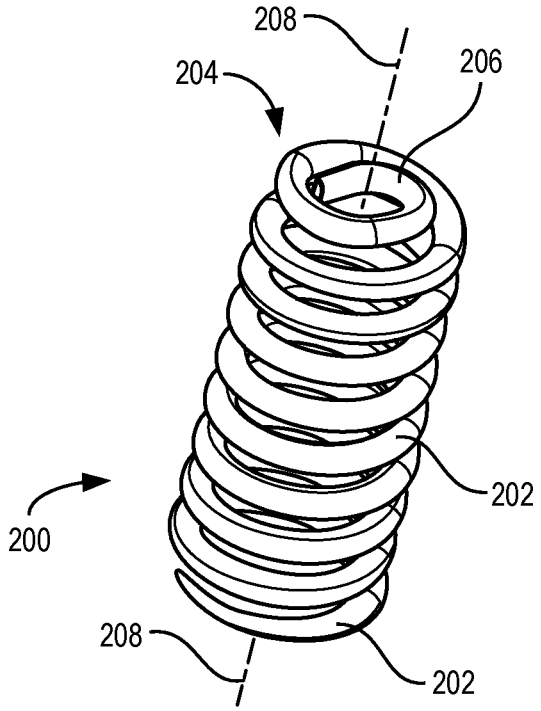
FIG. 2 shows a perspective view of a coil spring of a valve train of an internal combustion engine.
Figure 3:
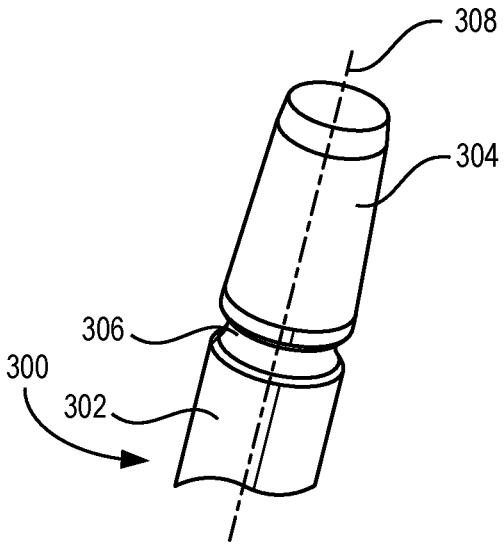
FIG. 3 shows a partial, perspective view of a valve stem of the valve train of the internal combustion engine.

FIG. 3 shows a valve stem 302 of a valve train of an internal combustion engine (e.g., engine 10 of FIG. 1) in a partial, perspective view. FIG. 3 shows the end 204 of the valve 300 or stem 302 on valve train side 407 (shown by FIG. 4). The valve stem 302 has a groove 306 running around the valve stem 302, in which the last winding 206 of the coil spring 200 from FIG. 2 can engage. Groove 306 encircles central axis 308 of the valve stem 302 and may be referred to herein as an annular groove. The central axis 308 may be referred to herein as a longitudinal axis of the valve stem 302.

The valve stem 302 tapers at its end 304 on the valve train side 407, starting from the groove 306, in the direction of the longitudinal axis 308 of the valve 300. In the example shown by FIG. 3, the valve stem 302 is formed conically at its end 304 on the valve train side (e.g., with a conical or frusto-conical cross-section in planes parallel with the central axis 308).

FIG. 4 shows a partial perspective view of the coil spring 200 of FIG. 2 coupled with the valve stem 302 of FIG. 3 in mounted state.

In mounted state, the last winding 206 of the coil spring 200 on the valve train side 407 engages in the groove 306 running around the valve stem 302 (e.g., the annular groove formed by the valve stem 302), on both sides of the stem 302, in the manner of a clip or pincer. Specifically, the valve stem 302 is positioned between legs of the last winding 206, as described further below, with each of the legs engaged with the annular groove 306 (e.g., in face-sharing contact with the annular groove 306, with no other components positioned therebetween).

FIG. 5 shows the coil spring 200 of FIGS. 2 and 4 viewed in a direction of the longitudinal axis 308 onto the end 204 of the coil spring 200 on the valve train side 407. The longitudinal axis 308 of the coil spring 200 stands perpendicular to a plane of FIG. 5. In other words, FIG. 5 shows the coil spring 200 in a view along the longitudinal axis 308, from the valve train side 407.

The last winding 206 of the coil spring 200 on the valve train side is formed U-shaped and has two opposing legs 500 and 502 (e.g., first leg 500 and opposing, second leg 502) spaced apart from each other, which engage in the groove 306 running around the valve stem 302 shown in FIGS. 3-4. The two opposing legs 500 and 502 are formed together as a continuous piece with the last winding 206 and the windings 202. Specifically, the last winding 206 is one of the windings 202, with each of the windings 202 being formed by a single, continuous length of material (e.g., metal). As described above, the valve spring 200 may be made from a round wire. The round wire may be a single, continuous piece shaped to form the windings 202 and the last winding 206, with the two opposing legs 500 and 502 each being opposing sections of the last winding 206 positioned opposite to each other across the central axis 208. Each of the first leg 500 and second leg 502 may extend parallel to each other and may be joined by a curved section 510 of the last winding 206, with the curved section 510 curving around the central axis 208 (e.g., curving within the plane of the view shown by FIG. 5, as indicated by arrow 512). The curved section 510 curves in an inward direction of the central axis 208 (e.g., curves in a direction toward the central axis 208) from the second leg 502 to the first leg 500.

The two opposing legs 500 and 502 are each curved in the region with which the legs 500 and 502 engage in the groove. The legs 500 and 502 are here formed concavely on the groove side and thus follow the casing surface of the stem 302 or the groove contour.

The two legs 500 and 502 are movable relative to each other and in particular can be spread apart, enlarging their spacing (e.g., the spacing between the legs 500 and 502).

In unloaded state, the two opposing legs 500 and 502 of the last winding 206 have a first spacing 504. During mounting, when the spring 200 is pushed in the direction of the longitudinal axis 308, the two legs 500 and 502 are spread apart starting from first spacing 504 to a greater, second spacing 508, with the second spacing 508>first spacing 504 (e.g., the second spacing 508 is greater than the first spacing 504). When the legs 500 and 502 engage in the groove 306, the spacing reduces again, in the present case to a smaller, third spacing 506, with the third spacing 506>first spacing 504 (e.g., the third spacing 506 is greater than the first spacing 504).

FIG. 6 shows a partial, cross-sectional view of the valve stem 302 shown by FIGS. 3-4. The view shown by FIG. 6 is a cross-sectional view in a plane parallel to the longitudinal axis 308 (e.g., a plane defined by the longitudinal axis 308 and an axis extending radially from the longitudinal axis 308).

The end 304 of the stem 302 on the valve train side 407 tapers in the direction of the longitudinal axis 308, starting from a groove 306 running around the valve stem 302 and provided on the valve stem 302. The groove 306 has a radius of curvature 600 at the groove base 602 (which may be referred to herein as an innermost point, lowest point, and/or innermost surface). In other words, the curvature of the groove 306 is shaped as a portion (e.g., arc) of a circumference of circle 601 illustrated by dotted lines for clarification purposes.

The groove 306 includes lowest point 602. The lowest point 602 is a portion of the groove 306 that is positioned closest to the longitudinal axis 308 of the valve stem 302, as indicated by length 620 in a radial direction of the longitudinal axis 308. The length 620 extends between the longitudinal axis 308 and axis 604, with the axis 604 being positioned tangentially relative to the lowest point 602 and parallel to the longitudinal axis 308. In this configuration, the groove 306 forms a depression or recess of the valve stem 302 relative to outer surfaces (e.g., exterior surfaces) of the valve stem 302 (e.g., exterior surface 610). The annular groove 306 is positioned at the end 304 of the valve stem 302 and extends along a perimeter of the exterior surface 610 of the valve stem 302.

FIG. 7 shows a partial, cross-sectional view of a portion of the coil spring 200 shown by FIGS. 2 and 4, together with the valve stem 302 shown in FIGS. 3 and 4, in the mounted state. The view shown by FIG. 7 is a cross-sectional view through the longitudinal axes 208 and 308 (e.g., similar to the plane of the view shown by FIG. 6).

The last winding 206 of the coil spring 200 on the valve train side 407 (e.g., the winding including the two legs 500 and 502) in the cross-sectional view shown by FIG. 7 have a radius of curvature 701 on the groove side which is greater than the radius of curvature 600 of the groove 306 at the groove base 602. Circle 601 described above with reference to FIG. 6 is additionally shown by FIG. 7 in order to further illustrate the curvature of the groove 306 (e.g., radius of curvature) relative to the curvature of the last winding 206 (e.g., the diameter or radius of the last winding 206).

In mounted state of the valve spring 200, the form-fit connection between the groove 306 and the last winding 206 therefore has a play at the groove base 602. An air gap is formed at the lowest point 602 of the groove 306. The two legs 500 and 502 each have contact (e.g., face-sharing contact) with the stem 302 at a plurality of points (e.g., locations). For example, first leg 500 contacts the valve stem 302 at points 700 and 702 (e.g., first point 700 and second point 702), and second leg 502 contacts the valve stem 302 at points 704 and 706 (e.g., third point 704 and fourth point 706). The contact between the legs and the valve stem 302 may be localized in some examples (e.g., only at the points 700, 702, 704, and 706). Specifically, first point 700, second point 702, third point 704, and fourth point 706 may each positioned further from the central axis 308 of the valve stem 302 than the innermost surface 602 of the annular groove 306, and the legs 500 and 502 may couple to the annular groove 306 at only the first point 700, second point 702, third point 704, and fourth point 706. In other examples, the valve stem 302 may contact the legs along one or more lengths of the valve stem 302 (e.g., annular surfaces of the valve stem 302 extending along a perimeter of the valve stem 302, around longitudinal axis 308 of the valve stem 302). The points at which the legs 500 and 502 contact with the stem 302 are spaced apart from other along the stem 302, reducing a likelihood of degradation of the spring 200. Further, because the radius of curvature 701 of the last winding 206 is greater than the radius of curvature 600 of the groove 306, the legs 500 and 502 may not come into contact (e.g., face-sharing contact) with the lowest point 602 of the groove 306.

The end 304 of the stem 302 on the valve train side 407 may taper in the direction of the longitudinal axis 308, such that a diameter of the stem 302 at the valve train side 407 (with the valve train side 407 shown by FIG. 4) is less than a diameter of the stem 302 at the cylinder side 409 (with the cylinder side 409 shown by FIG. 4). For example, the valve stem 302 may taper at its end 304 on the valve train side 407, starting from the groove 306, in the direction of the longitudinal axis 308 of the valve 300. The valve stem 302 may be formed conically at its end 304 on the valve train side 407.

Some embodiments of the internal combustion engine according to the present disclosure may include the valve stem tapered at its end on the valve train side.

A tapering valve stem end facilitates installation of the valve train, both on pressing of the valve spring onto the valve stem and on spreading of the last winding on the valve train side when the valve spring is pushed in the direction of the valve spring retainer until the last winding of the coil spring engages in a groove provided.

Some embodiments of the internal combustion engine according to the present disclosure may include the valve stem also tapered at its end on the valve train side starting from the groove. For example, the tapering stem end may directly adjoin the groove. In other words, the last winding on the valve train side may be spread increasingly when pushed along the longitudinal axis of the valve until it engages in the groove.

Some embodiments of the internal combustion engine according to the present disclosure may include the valve stem formed conically at its end of the valve train side. Then the last winding on the valve train side is spread continuously (e.g., steplessly increasing) when pushed along the longitudinal axis of the valve.

Since the stem preferably has a basically cylindrical form, the conical form of the end on the valve train side and the groove running around the valve stem can be formed easily, in some cases in one working step, for example by means of turning. In particular, valves already on the market can be equipped with a tapering stem end on the valve train side by further machining, and hence made suitable for use for an internal combustion engine according to the present disclosure.

Some embodiments of the internal combustion engine according to the present disclosure may include the coil spring made from a round wire. The round wire may be a circular round wire but also an oval wire.

Some embodiments of the internal combustion engine according to the present disclosure may include winding of the coil spring on the valve train side, at least on the groove side, such that the coil spring has in cross-section a radius of curvature 701 (shown by FIG. 7) which is greater than a radius of curvature 600 of the groove at the groove base (shown by FIG. 6).

In mounted state of the valve spring, the form-fit connection between the groove and the last winding has a play at least at the groove base (e.g., a small air gap is formed at the lowest point). Usually the last winding then has contact with the stem at two places, spaced from each other along the stem, on both sides of the stem. This gives security against twisting, e.g., against kinking of the spring or spring end transversely to the stem.

Some embodiments of the internal combustion engine according to the present disclosure may include the last winding of the coil spring on the valve train side formed with a U-shape. For example, the last winding of the coil spring may have a U-shaped basic form. The last winding may here have any possible clip-like or pincer-like shape, as long as the winding has two opposing legs or arms are spaced apart from each other and movable relative to each other, and which can be spread apart, in particular by enlarging their spacing, and in mounted state of the valve spring engage in the grooves running around the valve stem.

Some embodiments of the internal combustion engine according to the present disclosure may include the U-shaped last winding of the coil spring with two opposing legs spaced apart which engage in the groove running around the valve stem.

Some embodiments of the internal combustion engine according to the present disclosure may include the two opposing legs of the last winding of the coil spring in unmounted and unloaded state have a spacing 504. The spacing 504 defines the spacing of the legs of detached, unloaded coil springs in the region of future engagement in the groove (e.g., the spacing of the unloaded legs).

The two opposing legs of the last winding, when the coil spring is mounted and the legs are engaged in the groove, may again have the spacing 504 or a larger spacing 506, wherein 506>504. If the spacing 506 of the legs when the coil spring is mounted is greater than the spacing 504 of the unloaded spring or legs, in addition to the form fit by engagement, a force fit is achieved because of a spring spread force.

Some embodiments of the internal combustion engine according to the present disclosure may include the two opposing legs of the last winding of the mounted coil spring configured such that, when the legs are engaged in the groove, the legs have a spacing 506, wherein: 506>504, so that a force-fit connection is formed between the valve stem and the last winding.

Some embodiments of the internal combustion engine according to the present disclosure may include the two opposing legs of the last winding configured such that, during mounting of the coil spring, for part of the time the legs have a spacing 508, wherein: 508>504.

Some embodiments of the internal combustion engine according to the present disclosure may include the two opposing legs of the last winding, during mounting of the coil spring, for part of the time have a spacing 508, wherein: 508>506.

Some embodiments of the internal combustion engine according to the present disclosure may include the two opposing legs of the last winding curved at least in the region of the groove, wherein the legs are formed concavely on the groove side. The two legs to a certain degree follow the stem contour (e.g., the casing surface of the stem).

Some embodiments of the internal combustion engine according to the present disclosure may include the two opposing legs formed in the manner of a clip, wherein the legs each have at least one recess. The legs then engage in the groove in the region of the recess. The legs or arms may also be formed undulating.

Some embodiments of the internal combustion engine according to the present disclosure may include at least one cam follower element provided for each valve, wherein each cam follower element is arranged in the force flow between the camshaft and the associated valve.

The at least one cam follower element may be a tappet, a rocker arm or a swing arm. The use of arms ensures that sufficient installation space is made available for the arrangement of the valve train in the cylinder head.

The present disclosure additionally includes a method for mounting a valve spring of a valve train of an internal combustion engine, in which the valve stem is formed conically at its end on the valve train side, and the U-shaped last winding of the coil spring has two opposing legs spaced apart from each other, is achieved by a method which is distinguished in that, for the purpose of installation, the coil spring is pressed onto the valve stem, and the last winding of the coil spring is pushed along the longitudinal axis of the valve in the direction of the valve retainer until the two legs engage in the groove provided on the valve stem, wherein the two opposing legs of the last winding, during pushing, are initially spread starting from a spacing A to a greater spacing B>A, which is reduced again to a smaller spacing when the legs engage in the groove.

That which has already been stated with regard to the internal combustion engine according to the present disclosure also applies to the method according to the present disclosure, for which reason reference is generally made at this juncture to the statements made above with regard to the internal combustion engine. The different internal combustion engines may utilize, in part, different method variants.

Method variants include embodiments in which the two opposing legs of the last winding, during pushing, are initially spread starting from a spacing 504 to a greater spacing 508>504, which is reduced again to a smaller spacing 506 when the legs engage in the groove, wherein: 504<506<508.

If the spacing 506 of the legs when the coil spring is mounted is greater than the spacing 504 of the unloaded spring or legs, in addition to the form fit due to engagement, a force fit is achieved because of a spring spread force.

The poppet valve 300 and valve spring 200 may together be referred to herein as a valve assembly or cylinder valve assembly, in some examples.

FIGS. 2-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In this way, the valve spring may couple to the valve stem without additional fasteners. Specifically, the legs of the valve spring engage with the groove of the valve stem in order to lock the valve spring to the valve stem without a retainer (e.g., valve spring retainer) on the valve train side. Further, the valve spring is locked to the valve stem via the legs engaged with the groove without fusing (e.g., welding, gluing, etc.) of the valve spring to the valve stem. As a result, a weight, cost, and/or assembly time of the valve assembly may be reduced. The reduced weight of the valve assembly may result in increased engine performance due to a reduced inertia of the valve assembly, enabling the poppet valve to be driven by the engine with a reduced amount of force and reducing a load of the engine.

The technical effect of coupling the legs of the valve spring with the annular groove of the valve stem is to lock the valve spring to the poppet valve without additional fasteners or fusing.

In one embodiment, a valve assembly for an engine cylinder comprises: a poppet valve including a valve stem having an annular groove, the annular groove encircling a central axis of the valve stem; a biasing member including a plurality of legs adapted to engage with the annular groove to lock the biasing member to the poppet valve; and wherein the biasing member is locked to the poppet valve only by the plurality of legs. In a first example of the valve assembly, the valve assembly further includes wherein the annular groove is positioned at an end of the valve stem, with the annular groove extending along a perimeter of an exterior surface of the valve stem, and wherein the plurality of legs includes a first leg and an opposing, second leg, with the annular groove of the valve stem adapted to couple with the plurality of legs between the first leg and the second leg. A second example of the valve assembly optionally includes the first example, and further includes wherein the first leg is adapted to couple with the annular groove at only both of a first point and a second point, and wherein the second leg is adapted to couple with the annular groove at only both of a third point and a fourth point, with the first, second, third, and fourth points each positioned further from the central axis of the valve stem than an innermost surface of the annular groove. A third example of the valve assembly optionally includes one or both of the first and second examples, and further includes wherein the biasing member is a coil spring and the plurality of legs includes only the first leg and the second leg, with the first and second legs formed by an end coil of the coil spring.

In another representation, a hybrid electric vehicle comprises: an engine; an electric machine coupled to a transmission of the vehicle and adapted to selectably provide a driving torque to the vehicle; and a valve assembly for cylinder of the engine, the valve assembly comprising: a poppet valve including a valve stem having an annular groove, the annular groove encircling a central axis of the valve stem; and a biasing member including a plurality of legs adapted to engage with the annular groove to lock the biasing member to the poppet valve.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An internal combustion engine, comprising:

at least one cylinder head comprising at least one cylinder, where each cylinder has at least one outlet opening for discharging exhaust gases via an exhaust gas discharge system and at least one inlet opening for supplying fresh air via an intake system, where, for each outlet and inlet opening, a poppet valve of a valve train and a valve-actuating device included with a camshaft is provided for actuating the poppet valve, and where each poppet valve has a valve stem on an end of a cylinder side, facing the at least one cylinder where a valve retainer corresponding to the at least one outlet opening or the at least one inlet opening is arranged, and where each poppet valve has an end on a valve train side which faces the valve-actuating device, with each poppet valve mounted so as to be translationally movable in a corresponding sleeved valve stem guide so that on actuation and with the camshaft rotating, each poppet valve executes an oscillating stroke movement in a direction of its longitudinal axis between a valve closing position and a valve opening position in order to open and block a corresponding outlet or inlet opening, wherein each poppet valve includes a coil spring as a valve spring which pretensions the poppet valve in a direction of the valve closing position; and wherein each coil spring comprises several windings and rests on the cylinder side on the at least one cylinder head and on the valve train side on the valve stem, wherein a groove is provided running around the valve stem, wherein a last winding of the coil spring on the valve train side engages the groove, so that a form-fit connection is created between the valve stem and the last winding.

2. The internal combustion engine of claim 1, wherein the valve stem tapers at its end on the valve train side.

3. The internal combustion engine of claim 2, wherein the valve stem tapers at its end on the valve train side starting from the groove.

4. The internal combustion engine of claim 2, wherein the valve stem is formed conically at its end on the valve train side.

5. The internal combustion engine of claim 1, wherein the coil spring is made from a round wire.

6. The internal combustion engine of claim 1, wherein the last winding of the coil spring on the valve train side, at least on a groove side, has in cross-section a radius of curvature which is greater than a radius of curvature of the groove at a groove base.

7. The internal combustion engine of claim 1, wherein the last winding of the coil spring on the valve train side is formed U-shaped.

8. The internal combustion engine of claim 7, wherein the U-shaped last winding of the coil spring has two opposing legs spaced apart from each other which engage in the groove running around the valve stem.

9. The internal combustion engine of claim 8, wherein the two opposing legs of the last winding of the coil spring, in an unloaded and unmounted state, have a first spacing.

10. The internal combustion engine of claim 9, wherein the two opposing legs of the last winding of the coil spring in a mounted state, when the legs are engaged in the groove, have a second spacing, wherein: the second spacing is greater than the first spacing, so that a force-fit connection is formed between the valve stem and the last winding.

11. The internal combustion engine of claim 9, wherein during mounting of the coil spring, the two opposing legs of the last winding for a part of a time of the mounting have a third spacing, wherein: the third spacing is greater than the first spacing.

12. The internal combustion engine of claim 8, wherein the two opposing legs of the last winding are curved at least in a region of the groove, wherein the legs on a groove side are formed concavely.

13. The internal combustion engine of claim 8, wherein the two opposing legs are formed in a manner of a clip, wherein the legs each have at least one recess.

14. The internal combustion engine of claim 1, wherein at least one cam follower element is provided for each poppet valve, wherein each cam follower element is arranged in a force flow between the camshaft and a poppet valve associated with the cam follower element.

15. A method for mounting a valve spring of an internal combustion engine, comprising:

forming a valve stem conically at its end on a valve train side, and shaping a u-shaped last winding of the valve spring with two opposing legs spaced apart from each other;

installing the valve spring by pressing the valve spring onto the valve stem, with the u-shaped last winding of the valve spring being pushed along a longitudinal axis of the valve stem in a direction of a valve retainer until the two legs engage in a groove provided on the valve stem, where the two opposing legs of the u-shaped last winding are initially spread starting from a first spacing to a greater, second spacing while pressing the valve spring onto the valve stem, with the second spacing reduced to a smaller, third spacing when the legs engage in the groove.

16. The method of claim 15, wherein during pushing of the u-shaped last winding, the two opposing legs of the u-shaped last winding are initially spread starting from the first spacing to the greater, second spacing, which is reduced again to the smaller, third spacing when the legs engage in the groove, with the first spacing being less than the third spacing, and with the third spacing being less than the second spacing.

17. A valve assembly for an engine cylinder, comprising:

a poppet valve including a valve stem having an annular groove, the annular groove encircling a central axis of the valve stem;

a biasing member including a plurality of legs adapted to engage with the annular groove to lock the biasing member to the poppet valve; and wherein the biasing member is locked to the poppet valve only by the plurality of legs.

18. The valve assembly of claim 17, wherein the annular groove is positioned at an end of the valve stem, with the annular groove extending along a perimeter of an exterior surface of the valve stem, and wherein the plurality of legs includes a first leg and an opposing, second leg, with the annular groove of the valve stem adapted to couple with the plurality of legs between the first leg and the second leg.

19. The valve assembly of claim 18, wherein the first leg is adapted to couple with the annular groove at only both of a first point and a second point, and wherein the second leg is adapted to couple with the annular groove at only both of a third point and a fourth point, with the first, second, third, and fourth points each positioned further from the central axis of the valve stem than an innermost surface of the annular groove.

20. The valve assembly of claim 18, wherein the biasing member is a coil spring and the plurality of legs includes only the first leg and the second leg, with the first and second legs formed by an end coil of the coil spring.

* * * * *